US007187277B2

(12) United States Patent
Kobayashi

(10) Patent No.: US 7,187,277 B2
(45) Date of Patent: Mar. 6, 2007

(54) MONITORING TERMINAL DEVICE

(75) Inventor: Ikutaro Kobayashi, Tokyo (JP)

(73) Assignee: NEC Corporation, Tokyo (JP)

( * ) Notice: Subject to any disclaimer, the term of this patent is extended or adjusted under 35 U.S.C. 154(b) by 113 days.

(21) Appl. No.: 10/854,423

(22) Filed: May 27, 2004

(65) Prior Publication Data

US 2004/0239525 A1 Dec. 2, 2004

(30) Foreign Application Priority Data

May 28, 2003 (JP) ..... 2003-150062

(51) Int. Cl.
*G08B 1/08* (2006.01)

(52) U.S. Cl. ..... 340/539.1; 340/539.12; 340/539.13; 340/539.19; 340/506

(58) Field of Classification Search ..... 340/539.1, 340/539.12, 539.13, 539.19, 506
See application file for complete search history.

(56) References Cited

U.S. PATENT DOCUMENTS 6,940,403 B2 * 9/2005 Kail, IV ..... 340/539.12

FOREIGN PATENT DOCUMENTS

JP 2002-42082 2/2002

* cited by examiner

*Primary Examiner*—Daryl C Pope
(74) *Attorney, Agent, or Firm*—McGinn IP Law Group, PLLC

(57) ABSTRACT

A monitoring terminal device is provided which is capable of reducing its power consumption to a minimum and of being fully operated even indoors by using a solar cell as a power source. In the monitoring terminal device including a sensor unit, the transmitting unit to transmit, by wireless, a sensor monitoring output, and a control unit which control the sensor unit and the transmitting unit, further including a power supply section, when only state change of object to be monitored, that is, a output of the sensor unit is detected the control unit and the transmitting unit are started to transmit monitoring information by the sensor unit. When the sensor unit and the generating section are not activated supply of power to the sensor unit and the generating section is stopped and the control unit by itself is put into standby state, which enables reduction of power consumption to a minimum. This ensures a operation of the monitoring terminal device even in an environment in which power is not supplied from the outside.

16 Claims, 8 Drawing Sheets

*FIG.2*

| | | | | | | | | |
|---|---|---|---|---|---|---|---|---|
| | *preamble portion* | *synchronizing signal* | *ID of communication section* | *ID of sensor* | *ID of destination* | *sensor data* | *auxiliary data* | |

*(1010)*

| | |
|---|---|
| *preamble portion* | *: 5 bits* |
| *synchronizing signal* | *: 8 bits* |
| *ID of communication section* | *: 8 bits* |
| *ID of sensor* | *: 8 bits* |
| *ID of destination* | *: 8 bits* |
| *sensor data* | *: 32 bits* |
| *auxiliary data* | *: 8 bits* |

MONITORING TERMINAL DEVICE

BACKGROUND OF THE INVENTION

1. Field of the Invention

The present invention relates to a monitoring terminal device and more particularly to the monitoring terminal device having a sensor and a wireless communication unit to transmit, by wireless, a monitoring output fed from the sensor.

The present application claims priority of Japanese Patent Application No. 2003-150062 filed on May 28, 2003, which is hereby incorporated by reference.

2. Description of the Related Art

Applications of communications terminals in a communication network typified by the Internet are spreading out from a personal computer and/or a portable cellular phone to an information household electrical appliance. Moreover, by placing various sensors that can observe and monitor a variety of physical quantities in every location where needed in an artificial environment and/or a natural environment and by using information fed from these sensors, it is anticipated that the artificial environment and/or the natural environment will be systematically controlled.

That is, it is expected that a sensor and/or an alarm device placed in the natural environment and, moreover, various sensors and/or alarm devices placed in buildings and/or homes making up the artificial environment will be connected to a network and a monitoring output fed from these sensors and/or alarm devices will be utilized. For example, such a monitoring output can be used for managing temperatures of a paddy field or for detecting a landslide or a like in the natural environment, for checking on an opening or closing state of a window or an operating state of electrical appliances in a household environment, and for checking a state of various alarm devices at an entrance door using a portable cellular phone or a like before going out.

In these sensors, when they are placed in the natural environment in particular, it is desirable that supply of power from the outside or wiring for transmission of information is no longer needed. Therefore, these sensors have to have the same function of transmitting information as a wireless transmitting device, such as a radio transmitter, and an optical transmitter, has and it is necessary that their terminals can operate for a long time without supply of power from the outside.

Technology aiming at reducing power consumption in a non-contact type IC (Integrated Circuit) tag embedding a battery is disclosed in Japanese Patent Application Laid-open No. 2002-42082 (See Pages 3 and 4, and FIG. 6.) in which a sleeping state of a CPU (Central Processing Unit) in the IC tag is changed to its operating state in response to an external trigger. That is, the CPU in the IC tag is ordinarily put in the sleeping state and, only when communication between the IC tag and an external device is required, the CPU is put into its operating state by feeding a trigger to the CPU from the external device.

However, the above-disclosed technology has a disadvantage. That is, in order to receive a trigger from the external device, a trigger receiving section of the CPU has to be always put in its operating state and, as a result, it is impossible to reduce power consumption in the trigger receiving section.

SUMMARY OF THE INVENTION

In view of the above, it is an object of the present invention to provide a monitoring terminal device which is capable of reducing its power consumption to a minimum.

It is another object of the present invention to provide a monitoring device which is capable of being fully operated even indoors by using a solar cell as a power source.

According to a first aspect of the present invention, there is provided a monitoring terminal device including:

a sensor unit;

a wireless transmitting unit to transmit, by wireless, an out put from the sensor unit;

a control unit to control the wireless transmitting unit; and a power source managing unit to start and control the wireless transmitting unit and the control unit in response to the out put from the sensor unit.

According to a second aspect of the present invention, there is provided a monitoring terminal device including:

a sensor unit;

a wireless transmitting unit to transmit, by wireless, an out put from the sensor unit;

a control unit to control the wireless transmitting unit;

a timer to generate a starting signal in a fixed cycle; and a power source managing unit to start and control the wireless transmitting unit and the control unit in response to the output from the sensor unit and the starting signal from the timer.

In the first and second aspects, a preferable mode is one that which includes a fault diagnosis signal transmitting unit to transmit a signal for fault diagnosis in response to the starting signal from the timer.

Also, a preferable mode is one wherein the power source managing unit to start and control the wireless transmitting unit and the control unit in response to state change of the output from the sensor unit.

Also, a preferable mode is one wherein the power source managing unit supplies power to the wireless transmitting unit and the control unit while a specified period of time after starting.

Also, a preferable mode is one wherein the specified period of time is long enough for the wireless transmitting unit to transmit information.

Also, a preferable mode is one wherein the power source managing unit stops power supply for components other than the sensor unit and the timer after the specified period of time has passed.

Also, a preferable mode is one wherein power consumption of the sensor unit is zero in waiting state.

Also, a preferable mode is one wherein the sensor unit is a lead switch or a mercury switch.

Also, a preferable mode is one wherein the power source managing unit starts in response to a change in an output from the lead switch or the mercury switch.

Also, a preferable mode is one that includes a power source constructed of at least one of a solar cell, a secondary cell, and a capacitor.

Furthermore, a preferable mode is one wherein the solar cell is an amorphous type.

With the above configurations, including the sensor unit, the wireless transmitting unit, by wireless or alike, the power supply function (solar battery or a like), and the control function, when only the sensor unit detects state change of object to be monitored, the control unit and the wireless transmitting unit are started to transmit information. After completion of transmission supply of power to the wireless transmitting unit is stopped and further the control unit by itself other than a timer of the control unit is put into standby, which enables reduction of power consumption to a minimum. This ensures an operation of the monitoring terminal device for a long time even in an environment in which power is not supplied from the outside.

BRIEF DESCRIPTION OF THE DRAWINGS

The above and other objects, advantages, and features of the present invention will be more apparent from the following description taken in conjunction with the accompanying drawings in which:

FIG. 2 is a diagram showing an example of transmission data to be used in the first embodiment of the present invention;

DETAILED DESCRIPTION OF THE PREFERRED EMBODIMENTS

Best modes of carrying out the present invention will be described in further detail using various embodiments with reference to the accompanying drawings.

First Embodiment

Figure 1:
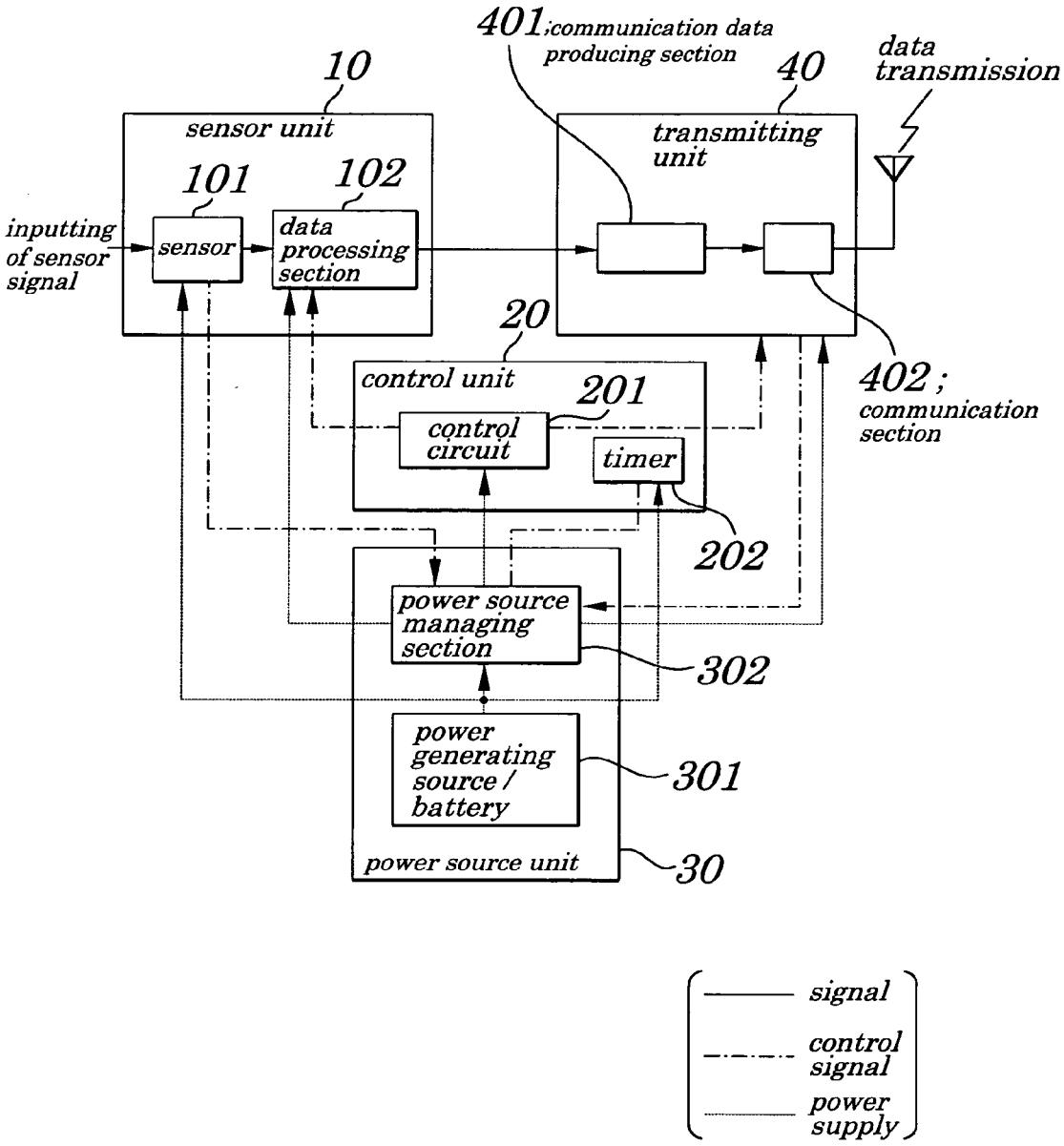
FIG. 1 is a configuration of a monitoring terminal device according to a first embodiment of the present invention.

FIG. 1 is a configuration of a monitoring terminal device according to a first embodiment of the present invention. As shown in FIG. 1, the monitoring terminal device of the embodiment includes a sensor unit 10 to observe and monitor a specified kind of physical quantity, a control unit 20, a power source unit 30, and a transmitting unit 40.

The sensor unit 10, which converts a physical quantity such as a temperature into an electrical signal, is made up of a sensor 101 used to output a starting signal to a power source managing section 302 by detecting a state change (a temperature change or a like) of an object to be monitored (measured). In the connection with measurement of temperatures, there is a bimetallic thermometer, as one example of the sensor 101, and more, a proximity perception sensor using a lead switch (a opening or closing window sensor or a like), a mercury switch for detecting slope to be used for detecting tumble of a kerosene heater, and a thermistor to be used for a fire alarm or a like.

The sensor unit 10 is made up of a data processing section 102 used to produce measurement data by performing data processing including an A/D (Analog to Digital) conversion of the electrical signal fed from the sensor 101, accumulation of data, detection of a change in data, addition of information obtained from each kind of objects to be monitored (measured) (such as temperatures), or a like.

The control unit 20 is made up of a control circuit 201 starts the data processing section 102 and the transmitting unit 40 after receiving power supply from the power source managing section 302 and lets the data processing section 102 and the transmitting unit 40 produce specified operation and a timer 202 outputs a starting signal to the power source managing section 302 every transmission cycle of a fault diagnosis signal.

The power source unit 30 includes a power generating source/battery 301 to supply power to the sensor unit 10, the control unit 20, and the transmitting unit 40. As the power generating source/the battery 301, a solar cell, a secondary cell, a capacitor, or a combination of them or only the solar cell can be used. When the monitoring terminal device is used indoors, in particular, an amorphous-type solar cell that can absorb well spectra from a fluorescent lamp is effectively employed.

The power source unit 30 also includes the power source managing section 302 feeds power supply to the control circuit 201, the data processing section 102,and the transmitting unit 40 by a starting signal from the sensor 101 or the timer 202 and starts the control circuit 201, the data processing section 102,and the transmitting unit 40 and stops feeding power supply to the control circuit 201, the data processing section 102,and the transmitting unit 40 by a communication complete signal from the transmitting unit 40.

The transmitting unit 40 is made up of a communication data producing section 401 to produce communication data used when measurement data fed from the data processing section 102 is transmitted by a communication section 402. In this case communication data, as one example, as shown in FIG. 2, is arranged in order of a preamble portion, a synchronizing signal for synchronization in communications, an ID (Identification) of an communication section, an ID of a sensor, an ID of a destination, a data region of the sensor, and an auxiliary data and a break of data is represented in a fixed-length format or a comma sign format. And the transmitting unit 40 is made up of the communication section 402 to transmit, by wireless (generally by wireless such as radio and light), communication data fed from communication data producing section 401.

Moreover, in FIG. 1, solid lines show a flow of data, alternate long and short dash lines show control signals, and broken lines show a flow of power supply.

A physical quantity (for example, a temperature in a room) in an artificial environment or in a natural environment is converted into an electrical signal by the sensor 101 in the sensor unit 10. Further, when detecting a state change (a temperature change or a like) of an object to be monitored, the sensor 101 outputs the starting signal to the power source managing section 302 to start feeding power supply to each section. In the connection with measurement of temperatures, there is a bimetallic thermometer, as one example of the sensor 101, and more, a proximity perception sensor using a lead switch (a opening or closing window sensor or a like), a mercury switch for detecting slope to be used for detecting tumble of a kerosene heater, and a thermistor to be used for a fire alarm or a like.

The power source managing section 302 being started to operate by the sensor 101 feeds power supply to the control circuit 201 and the data processing section 102 to produce measurement data by performing data processing including an A/D conversion of the electrical signal fed from the sensor 101, accumulation of data, detection of a change in data, addition of information obtained from each kind of objects to be measured (such as temperatures), or a like. Further the power source managing section 302 has the transmitting unit 40 start so as to produce communication data as shown in FIG. 2 by communication data producing section 401 and transmits communication data from the communication section 402.

Figure 3:
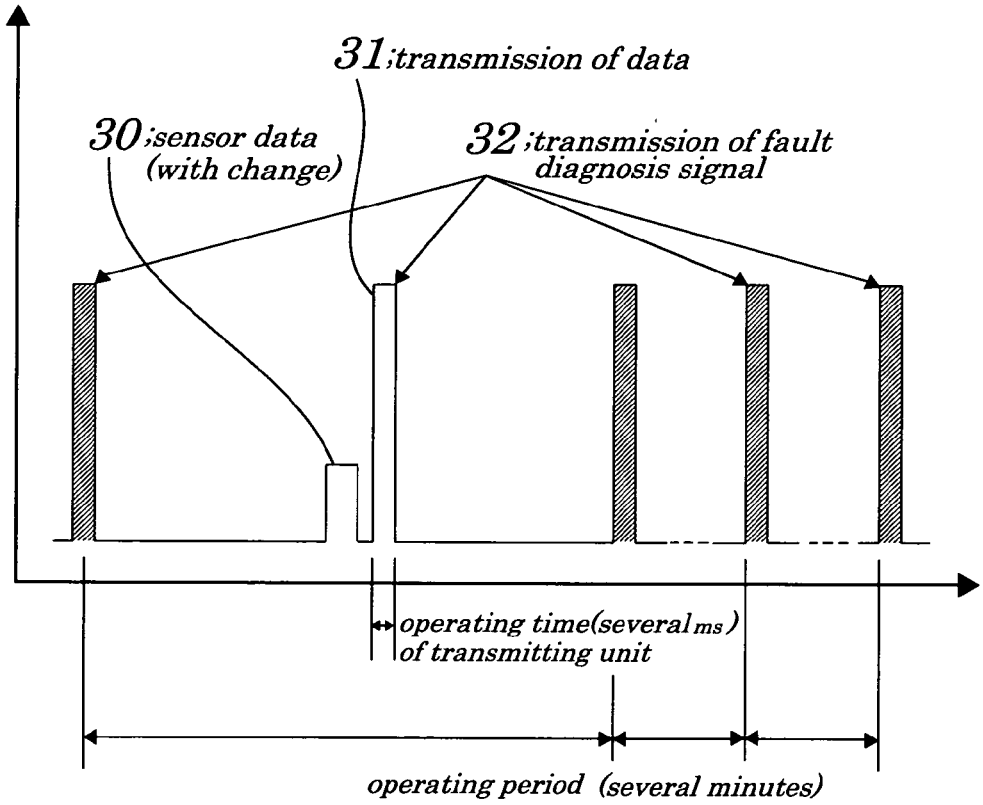
FIG. 3 is a diagram explaining a condition of reduction in power consumption by operating a wireless transmitting section only when a sensor unit is started and a signal for fault diagnosis is transmitted according to the first embodiment of the present invention.

After transmitting communication data, the power source managing section 302 stops supply of power to the data processing section 102, the control circuit 201, and the transmitting unit 40 by receiving transmit completion signal from the transmitting unit 40. That is, the transmitting unit 40 is operated intermittently as shown in FIG. 3. By operating the monitoring terminal device of the embodiment as above, currents required except when data is transmitted is standby current of only the sensor 101 and, therefore, power consumption is greatly reduced. The thermistor consumes power supply more or less because of being a resistance even during standby state. But the bimetallic thermometer, the lead switch, and the mercury switch consume no power supply at all when they are used setting the state of switch off into standby state, as a result, power consumption during standby can be zero perfectly.

In the present invention since the transmitting unit 40, only when a change in the physical quantity measured by the sensor unit 10 (as shown by the number "30" in FIG. 3) occurs, transmits communication data (as shown by the number "31" in FIG. 3), if the change is small, the transmitting unit 40 stops transmitting communication data for a long time, which serves to reduce current consumption accordingly, in other hand, makes difficult to judge the monitoring terminal device is operating normally or is out of commission. Therefore it is necessary to notify that the monitoring terminal device is operating normally, and for notifying it is desirable that a fault diagnosis signal (a signal as shown by the reference number "32" in FIG. 3) is transmitted in every specified period of time.

Therefore, irrespective of the starting signal from the sensor 101 the control circuit 201 and the transmitting unit 40 are started by the starting signal from the timer 202 in a specified cycle so that the fault diagnosis signal is transmitted from the transmitting unit 40.

By setting the ratio (Operation duty=operating time/operating cycle) between the operating time and the operating cycle of the transmitting unit 40 at about $1/1000$ to $1/1000000$, current consumption in the operation state can be reduced to a degree that it can be neglected when compared with current consumption in standby state. In the embodiment of the present invention, the operating time of the sensor unit 10 and the transmitting unit 40 are set at several ms meanwhile the operating cycle (transmitting cycle of the fault diagnosis signal) is set at several seconds to several minutes. It is needless to describe that the operating time and the operating cycle are properly selected depending on an object to be measured.

Figure 4:
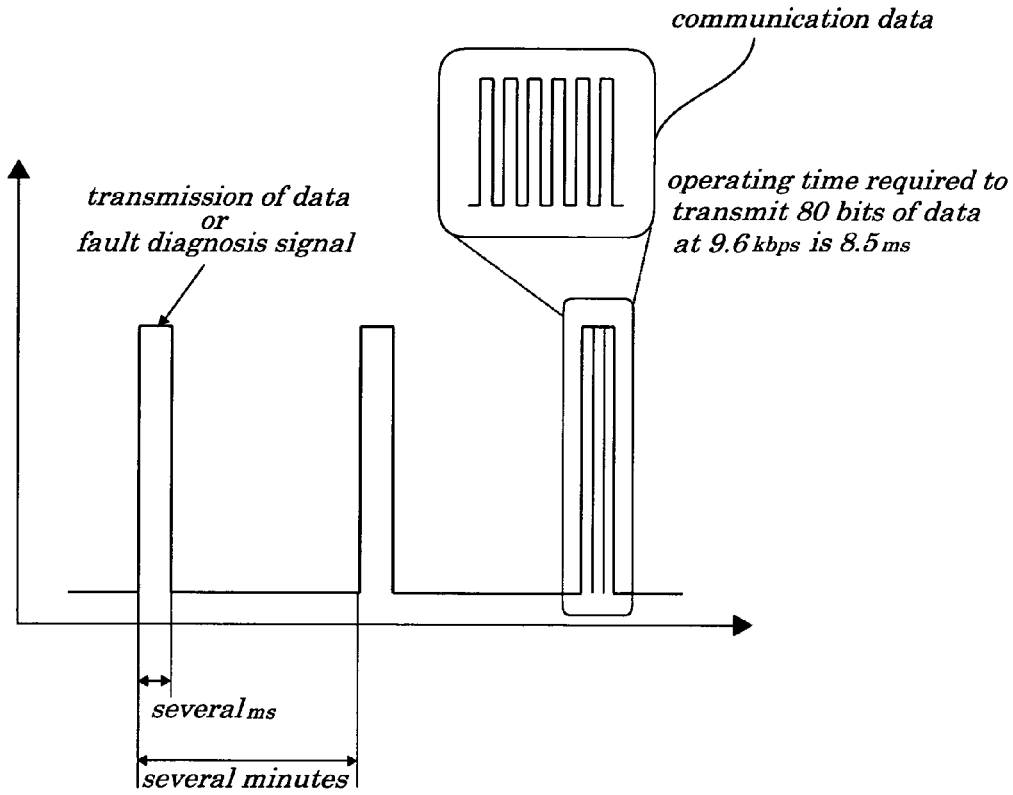
FIG. 4 is a diagram explaining reduction in power consumption achieved by a data transmission method employed in the transmitting unit according to the first embodiment of the present invention.

Moreover, completion of data transmission by the transmitting unit 40 in a short time can be achieved by increasing a bit rate of communication data. For example, when data (about 80 bits) having a frame configuration as shown in FIG. 2, if the data is transmitted at 9.6 kbps, required operating time is 8.5 ms as shown in FIG. 4.

Figure 5:
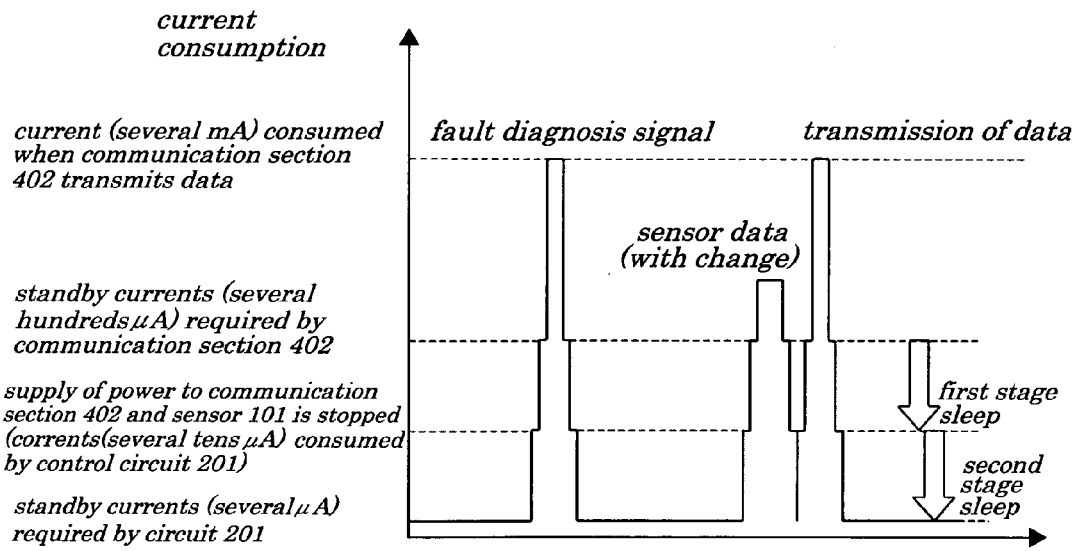
FIG. 5 is a diagram explaining management of power supply made by a control unit of the embodiment of the present invention.

In the monitoring terminal device of the embodiment of the present invention, while the state of standby, the power source managing section 302 stops feeding power supply to not only the data processing section 102 and the transmitting unit 40 (first stage sleep shown in FIG. 5) but also the power source managing section 302 itself and the control circuit 201 (second stage sleep shown in FIG. 5). That is, the standby power consumption becomes only the power consumption of the timer 202, which outputs the starting signal to the power source managing section 302 every transmitting cycle of the fault diagnosis signal. Therefore standby currents required by the monitoring terminal device can be reduced to several tensμA (in the case of the embodiment of the invention it is 1.5 μA) which is same as standby currents of the control circuit 201.

Therefore, even in an indoor place where sunlight does not reach directly, the monitoring terminal device can be fully operated using a solar cell (amorphous-type solar cell of the embodiment of the present invention can supply 9 μA of output current and emit 200 lux of light for indoor brightness).

Second Embodiment

Figure 6:
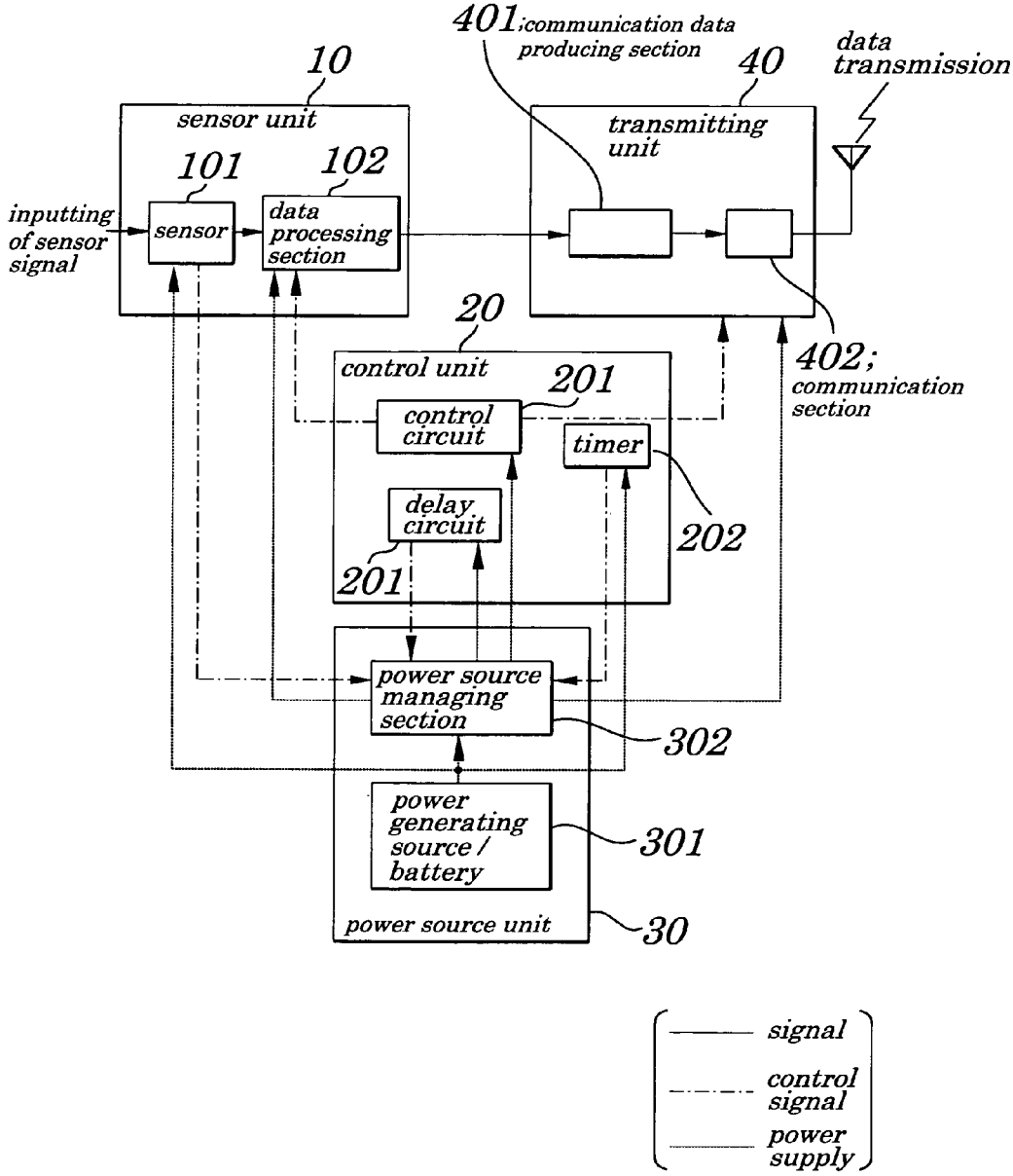
FIG. 6 is a block diagram of a monitoring terminal device of a second embodiment of the present invention.

FIG. 6 is a block diagram of a monitoring terminal device of a second embodiment of the present invention. In FIG. 6, same reference numbers are assigned to components having the same function as those in FIG. 1. In the second embodiment a delay circuit 203 is added to decide operation time of a control circuit 201, a data processing section 102, and a transmitting unit 40 other than the components shown in FIG. 1. The control circuit 201, which is started with power supply from a power source managing section 302, operates the data processing section 102 and the transmitting unit 40 during a specific period of time. The specific period of time is decided by a time constant of the delay circuit 203, which is also started with power supply from the power source managing section 302. As a matter of course data transmission must be reached completion within the above specific period of time.

A mono stable multi vibrator (MMV) or a counter can be used as one example of the delay circuit 203. Especially when communication data shown in FIG. 2 has a fixed-length, they work effectively.

Third Embodiment

Figure 7:
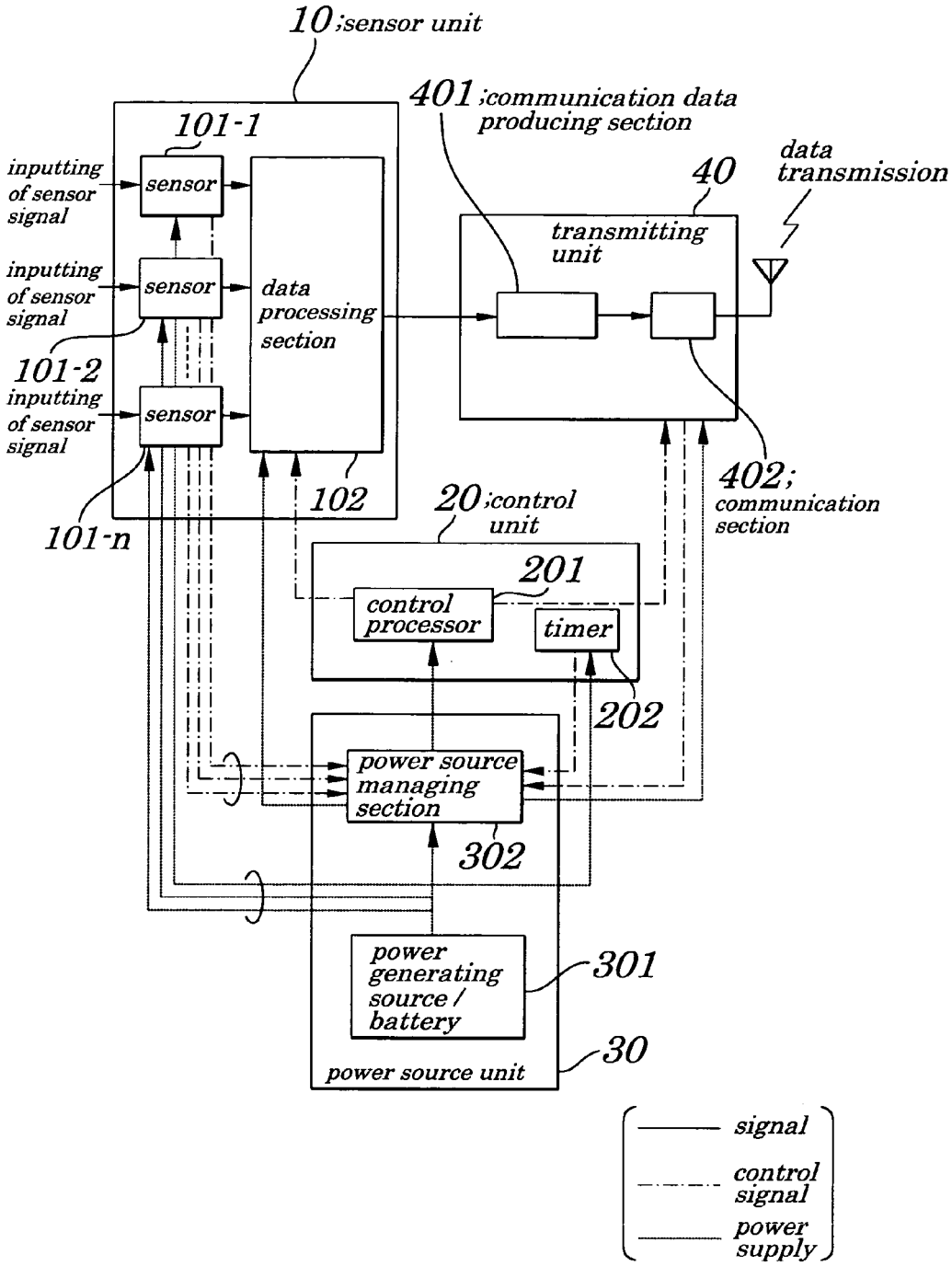
FIG. 7 is a block diagram of a monitoring terminal device according to a third embodiment of the present invention.
Figure 8:
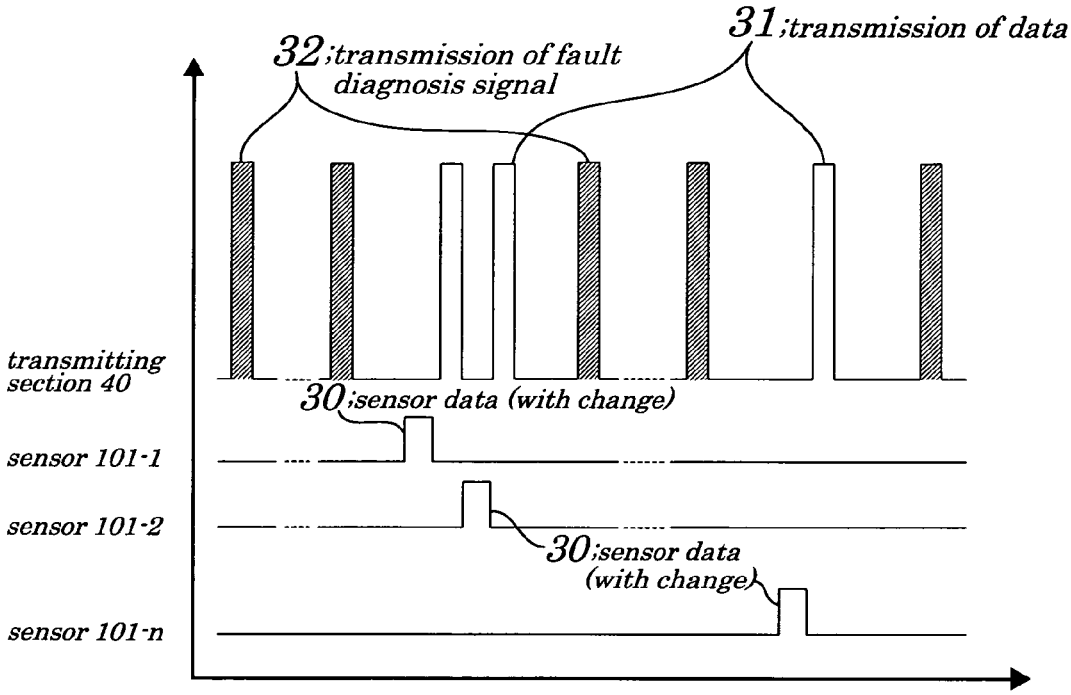
FIG. 8 is a diagram explaining operations of the monitoring terminal device in FIG. 7, according to the third embodiment of the present invention.

FIG. 7 is a block diagram of a monitoring terminal device according to a third embodiment of the present invention. In FIG. 7, same reference numbers are assigned to components having the same function as those in FIGS. 1 and 2. Referring to FIG. 7, a sensor unit 10 has two or more sensors 101-1 to **101-*n* ("n" is an integer being 2 or more), each of which monitors and measures a different physical quantity, and its data is transmitted from a transmitting unit 40. In the third embodiment, as an example of each of the sensors 101-1 to 101-*n*, a bimetallic thermometer for measurement of temperatures, a proximity perception sensor (lead switch) for detection of a closing or opening state of a window, or a mercury switch for detecting slope to be used for detecting tumble. Moreover, any sensor, so long as can start a power source managing section 302 with detecting state change (temperature change or a like) of object to be measured is not limited to sensors mentioned above. FIG. 8** is a diagram explaining each operations of the monitoring terminal device of the third embodiment of the present invention.

By constructing the control unit 20, the power source managing section 302, the transmitting unit 40, or the like using IC (Integrated Circuit) chips which can perform processes including the power source managing processing, the signal processing, and the frame construction processing in each above embodiments, it is made possible to standardize the monitoring terminal device of the present invention, which can provide advantages of easiness of design, reduction in manufacturing costs, or a like.

It is apparent that the present invention is not limited to the above embodiments but may be changed and modified without departing from the scope and spirit of the invention.

What is claimed is:

1. A monitoring terminal device comprising:

a sensor unit comprising a sensor and a data processing section to perform a data processing on an output from said sensor to produce an output data;

a wireless transmitting unit to transmit, by wireless said output data produced by said data processing section;

a control unit to control said data processing section and said wireless transmitting unit; and a power source managing unit to start power supply for said data processing section, said wireless transmitting unit and said control unit in response to state change of said output from said sensor, and to stop the power supply for said data processing section, said wireless transmitting unit and said control unit when a specified period of time has passed after the starting, wherein said specified period of time is long enough for said wireless transmitting unit to transmit information.

2. The monitoring terminal device according to claim 1, wherein power consumption of said sensor is zero in standby state.

3. The monitoring terminal device according to claim 2, wherein said sensor comprises a lead switch or a mercury switch.

4. The monitoring terminal device according to claim 3, wherein said power source managing unit starts the power supply in response to a change in an output from said lead switch or said mercury switch.

5. The monitoring terminal device according to claim 1, further comprising:

a power source including at least one of a solar cell a secondary cell, and a capacitor.

6. The monitoring terminal device according to claim 5, wherein said solar cell comprises an amorphous solar cell.

7. A monitoring terminal device comprising:

a sensor unit comprising a sensor and a data processing section to perform data processing on an output from said sensor to produce an output data;

a wireless transmitting unit to transmit, by wireless, said output data produced by said data processing section;

a control unit to control said data processing section and said wireless transmitting unit;

a timer to generate a starting signal in a fixed cycle;

a power source managing unit to start power supply for said data processing section, said wireless transmitting unit and said control unit in response to any one of said output from said sensor and said starting signal from said timer, and to stop the power supply for said data processing section, said wireless transmitting unit and said control unit after a specified period of time after the starting has passed; and a fault diagnosis signal transmitting unit to transmit a signal for fault diagnosis in response to said starting signal from said timer.

8. The monitoring terminal device according to claim 7, wherein said power source managing unit starts power supply for said data processing section, said wireless transmitting unit and said control unit in response to a state change of said output from said sensor.

9. The monitoring terminal device according to claim 7, wherein said specified period of time is long enough for said wireless transmitting unit to transmit information.

10. The monitoring terminal device according to claim 7, wherein power consumption of said sensor is zero in standby state.

11. The monitoring terminal device according to claim 10, wherein said sensor comprises a lead switch or a mercury switch.

12. The monitoring terminal device according to claim 11, wherein said power source managing unit starts the power supply in response to a change in an output from said lead switch or said mercury switch.

13. The monitoring terminal device according to claim 7, further comprising:

a power source including at least one of a solar cell, a secondary cell, and a capacitor.

14. The monitoring terminal device according to claim 13, wherein said solar cell comprises an amorphous solar cell.

15. The monitoring terminal device according to claim 7, wherein a ratio of an operating time to an operating cycle of said wireless transmitting unit is set at $1/1{,}000$ to $1/1{,}000{,}000$.

16. A monitoring terminal device comprising:

a sensor unit comprising a sensor and a data processing section to perform data processing on an output from said sensor to produce an output data;

a wireless transmitting unit to transmit, by wireless said output data produced by said data processing section;

a control unit to control said data processing section and said wireless transmitting unit; and a power source managing unit to start power supply for said data processing section, said wireless transmitting unit and said control a unit in a response to state change of said output from said sensor, and to stop the power supply for said data processing section, said wireless transmitting, unit and said control unit after receiving a communication complete signal from said wireless transmitting unit.

* * * * *